US009256192B2

(12) United States Patent
Fujikawa

(10) Patent No.: US 9,256,192 B2
(45) Date of Patent: Feb. 9, 2016

(54) IMAGE FORMING APPARATUS PROVIDED WITH ENGAGING PORTION CONFIGURED TO LOCK ACCESS ASSEMBLY

(71) Applicant: Brother Kogyo Kabushiki Kaisha, Nagoya-shi, Aichi-ken (JP)

(72) Inventor: Yasumasa Fujikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/524,719

(22) Filed: Oct. 27, 2014

(65) Prior Publication Data

US 2015/0117900 A1 Apr. 30, 2015

(30) Foreign Application Priority Data

Oct. 31, 2013 (JP) ..... 2013-226732

(51) Int. Cl.
*G03G 21/16* (2006.01)
*G03G 21/18* (2006.01)

(52) U.S. Cl.
CPC ..... *G03G 21/1633* (2013.01); *G03G 21/16* (2013.01); *G03G 21/1853* (2013.01); *G03G 2215/0119* (2013.01); *G03G 2221/1654* (2013.01); *G03G 2221/1684* (2013.01)

(58) Field of Classification Search
CPC ..... G03G 21/16
USPC ..... 399/110
See application file for complete search history.

(56) References Cited

U.S. PATENT DOCUMENTS 8,653,362 B2 * 2/2014 Tsujishita ..... 174/50
2011/0267657 A1 * 11/2011 Tsujishita ..... 358/296

FOREIGN PATENT DOCUMENTS

JP 2006-337477 * 12/2006 ..... G03G 15/00
JP 2006-337477 A 12/2006
JP 2011-230406 A 11/2011

* cited by examiner

*Primary Examiner* — Clayton E Laballe
*Assistant Examiner* — Kevin Butler
(74) *Attorney, Agent, or Firm* — Banner & Witcoff, Ltd.

(57) ABSTRACT

An image forming apparatus includes: a casing including a base portion, an access assembly, and a cover; first and second engaging portions; and an operating member. The access assembly is pivotally movable between an open position and a closed position. The cover has a recessed portion recessed from an edge thereof in a direction away from the access assembly in the closed position. The first engaging portion overlaps the cover as viewed from above. The second engaging portion is movable between an engaged position engageable with the first engaging portion and a disengaged position disengaged from the first engaging portion. The operating member is in the recessed portion when the access assembly is in the closed position, and movable between a lock position to lock the second engaging portion into the engaged position and an unlock position to unlock the second engaging portion into the disengaged position.

18 Claims, 10 Drawing Sheets

IMAGE FORMING APPARATUS PROVIDED WITH ENGAGING PORTION CONFIGURED TO LOCK ACCESS ASSEMBLY

CROSS REFERENCE TO RELATED APPLICATION

This application claims priority from Japanese Patent Application No. 2013-226732 filed Oct. 31, 2013. The entire content of the priority application is incorporated herein by reference.

TECHNICAL FIELD

The present invention relates to an image forming apparatus employing an electrophotographic system.

BACKGROUND

An electrophotographic image forming apparatus known in the art includes a casing, and an image forming unit mounted in the casing for forming images on a recording medium.

One such image forming apparatus that has been proposed includes a casing having an opening, a drawer that can be pulled out through the opening and supports a plurality of process cartridges for different colors used by the image forming apparatus, and a cover that opens and closes the opening.

In this conventional image forming apparatus, the cover has a hook that operates in association with a push-button, and the casing has a hook receiver that receives the hook provided at the cover.

With this configuration, in order to pivotally move the cover from its closed position to its open position, an operator presses the push-button, releasing the hook provided at the cover from the hook receiver provided at the casing and allowing the cover to move into the open position.

SUMMARY

However, in the conventional image forming apparatus described above, the hook receiver protrudes forward from a top edge of the casing.

Consequently, the hook receiver may get in the way of the operator performing operations near the opening in the casing, such as replacing the process cartridge, thereby reducing working efficiency.

In view of the foregoing, it is an object of the present invention to provide an image forming apparatus capable of improving working efficiency for an operator performing operations near an opening in a casing after moving an access assembly to its open position.

In order to attain the above and other objects, the present invention provides an image forming apparatus that may include: a casing; a first engaging portion; a second engaging portion; and an operating member. The casing may include: a base portion; an access assembly; and a cover. The access assembly may be provided at one side of the base portion and configured to pivotally move relative to the base portion between an open position and a closed position. The cover may be provided above the base portion. The cover may have an edge proximal to the access assembly in the closed position and a recessed portion recessed from the edge in a direction away from the access assembly in the closed position. The first engaging portion may be provided at a position overlapping the cover as viewed from above. The second engaging portion may be provided at the access assembly and configured to move between an engaged position in which the second engaging portion is in engagement with the first engaging portion and a disengaged position in which the second engaging portion is out of engagement with the first engaging portion. The operating member may be provided at the access assembly and configured to be positioned in the recessed portion when the access assembly is in the closed position. The operating member may be configured to move between a lock position to lock the second engaging portion into the engaged position and an unlock position to unlock the second engaging portion into the disengaged position.

DETAILED DESCRIPTION

1. Overall Structure of Printer

Figure 1:
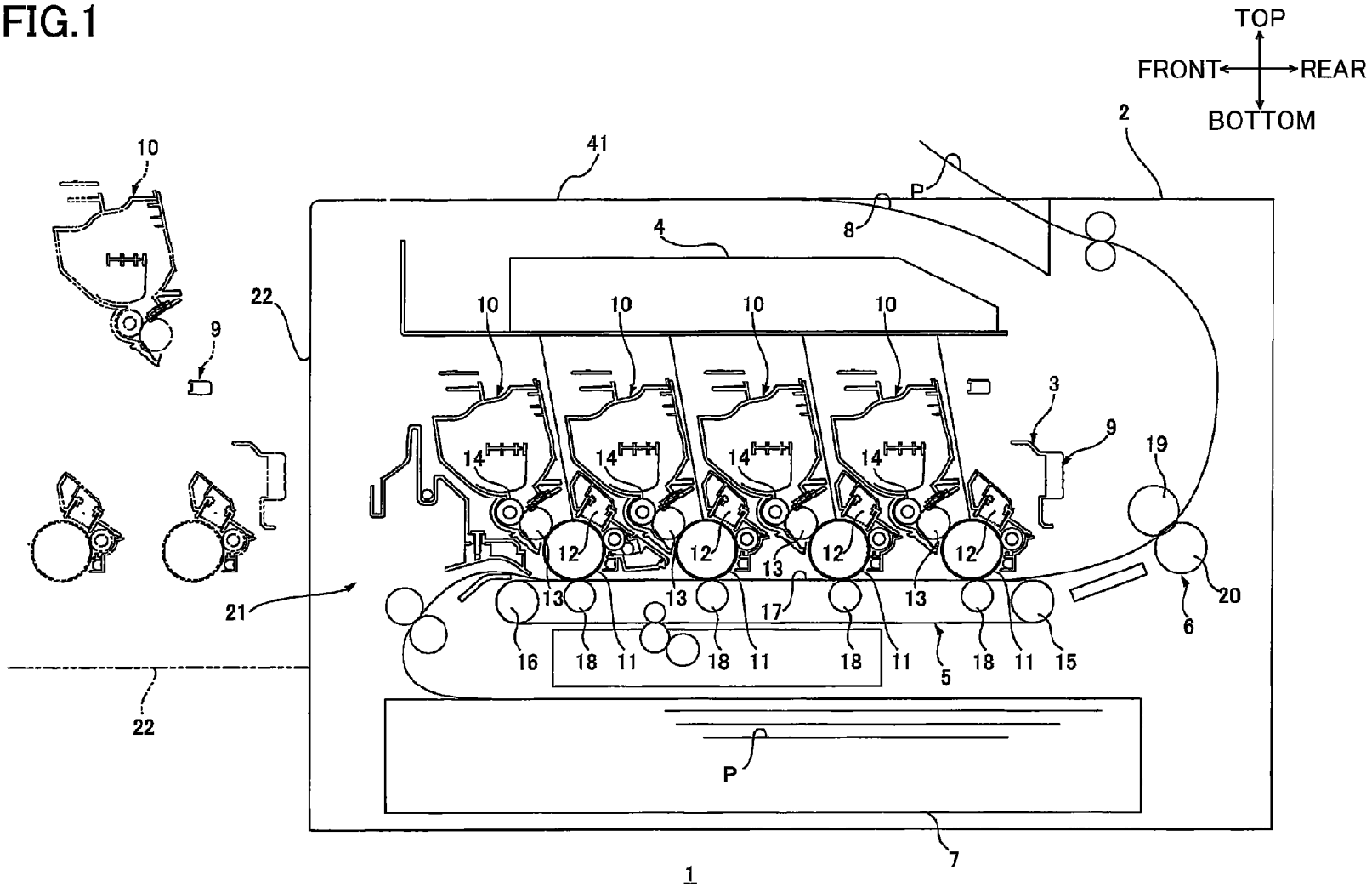
FIG. 1 is a center cross-sectional view of a printer as an image forming apparatus according to one embodiment of the present invention.

A printer 1 as an image forming apparatus according to one embodiment of the present invention will be described with reference to FIGS. 1 through 10B, wherein like parts and components are designated by the same reference numerals to avoid duplicating description.

The printer 1 shown in FIG. 1 is a horizontal-type direct tandem color laser printer.

In the following description, the terms "upward", "downward", "upper", "lower", "above", "below", "beneath", "right", "left", "front", "rear" and the like will be used assuming that the laser printer 1 is disposed in an orientation in which it is intended to be used. That is, directions related to the printer 1 will be given based on a state of the printer 1 when the printer 1 is resting on a level surface. More specifically, a right side and a left side in FIG. 1 are a rear side and a front side of the printer 1, respectively. Further, a right side and a left side of the printer 1 will be based on the perspective of a user facing the front side of the printer 1. Hence, a near side and a far side in FIG. 1 are the right side and the left side of the printer 1, respectively. Further, a top side and a bottom side in FIG. 1 are a top side and a bottom side of the printer 1, respectively. Further, a left-right direction is an example of an axial direction.

The printer 1 includes a main casing 2 as an example of a casing, a process unit 3, a scanning unit 4, a transfer unit 5, and a fixing unit 6.

The main casing 2 has a general box-like shape. The main casing 2 has an opening 21. The main casing 2 includes a front cover 22 as an example of an access assembly, a top cover 41 as an example of a cover, and a pair of side covers 42 as an example of a base portion, and a sheet supply tray 7 (see also FIG. 2).

The opening 21 is formed in a front end of the main casing 2. The opening 21 communicates with an interior and an exterior of the main casing 2 in a front-rear direction to allow passage of the process unit 3 therethrough.

The front cover 22 is provided at the front end of the main casing 2. The front cover 22 has a general plate-like shape. The front cover 22 extends vertically. The front cover 22 is supported to the side covers 42 so as to be pivotally movable about its lower end portion between an open position (see FIG. 3) for opening the opening 21, and a closed position (see FIG. 2) for closing the opening 21.

The sheet supply tray 7 is provided at a bottom portion of the main casing 2. The sheet supply tray 7 is configured to accommodate sheets P of paper as an example of a recording medium.

The process unit 3 is provided at a center portion of the main casing 2. While the front cover 22 is in its open position, the process unit 3 can move between an external position (indicated by two-dotted chain lines in FIG. 1) and an internal position (indicated by solid lines in FIG. 1). In the external position, the process unit 3 is positioned outside the main casing 2. In the internal position, the process unit 3 is positioned inside the main casing 2. The process unit 3 includes a drum unit 9, and a plurality of developer cartridges 10.

The drum unit 9 includes a plurality of photosensitive drums 11, and a plurality of scorotron chargers 12.

The photosensitive drums 11 are rotatably supported in a lower end portion of the process unit 3. The photosensitive drums 11 are arranged in juxtaposition with one another and are spaced at intervals in the front-rear direction. Each of the photosensitive drums 11 has a general cylindrical shape oriented with its axis in a left-right direction.

The scorotron chargers 12 are provided in one-to-one correspondence with the photosensitive drums 11. The scorotron chargers 12 are positioned on an upper rear side of the corresponding photosensitive drums 11 while being spaced apart therefrom.

The developer cartridges 10 are provided in one-to-one correspondence with the photosensitive drums 11. The developer cartridges 10 are positioned above the corresponding photosensitive drums 11. Each of the developer cartridges 10 includes a developing roller 13 and a supply roller 14. Each developer cartridge 10 has an internal space above the developing roller 13 and the supply roller 14 for accommodating toner in a corresponding color.

The developing rollers 13 are rotatably supported in lower end portions of the corresponding developer cartridges 10 such that their outer circumferential surfaces are exposed on rear sides of the developer cartridges 10. The developing rollers 13 are positioned to contact upper front portions of the corresponding photosensitive drums 11.

The supply rollers 14 are disposed on upper front sides of the corresponding developing rollers 13. The supply rollers 14 contact upper front portions of the corresponding developing rollers 13.

The scanning unit 4 is disposed above the process unit 3. The scanning unit 4 irradiates laser beams based on image data toward the photosensitive drums 11, as indicated by solid lines in FIG. 1, exposing surfaces of the photosensitive drums 11.

The transfer unit 5 is disposed below the process unit 3. The transfer unit 5 includes a drive roller 15, a follow roller 16, a conveying belt 17, and a plurality of transfer rollers 18.

The drive roller 15 is disposed on a rear end portion of the transfer unit 5.

The follow roller 16 is disposed frontward of the drive roller 15. More specifically, the follow roller 16 is disposed on a front end portion of the transfer unit 5 at a position opposing but spaced apart from the drive roller 15.

The conveying belt 17 is looped around the drive roller 15 and the follow roller 16 such that its upper portion contacts all of the photosensitive drums 11. The conveying belt 17 moves in a circulating manner as the drive roller 15 is driven and the follow roller 16 follows, such that its upper portion moves rearward.

The transfer rollers 18 are provided in one-to-one correspondence with the photosensitive drums 11. The transfer rollers 18 are disposed at positions beneath the corresponding photosensitive drums 11 with the upper portion of the conveying belt 17 interposed therebetween.

The fixing unit 6 is disposed rearward of the transfer unit 5. The fixing unit 6 includes a heating roller 19, and a pressure roller 20 that contacts the heating roller 19.

When the printer 1 starts an image-forming operation, the scorotron chargers 12 apply a uniform charge to the surfaces of the corresponding photosensitive drums 11. Subsequently, the scanning unit 4 exposes the charged surfaces of the photosensitive drums 11 to the laser beams, forming an electrostatic latent image on the surface of each photosensitive drum 11 based on the image data.

In the meantime, the supply rollers 14 supply toner from the corresponding developer cartridges 10 to the corresponding developing rollers 13. At this time, the toner is positively tribocharged between the developing rollers 13 and the corresponding supply rollers 14, and the charged toner is carried on the surfaces of the developing rollers 13.

Next, the developing rollers 13 supply the toner to the electrostatic latent images formed on the surfaces of the corresponding photosensitive drums 11, producing toner images on the surfaces of the photosensitive drums 11.

Various rollers in the printer 1 rotate to convey the sheets P from the sheet supply tray 7 along a U-shaped path that first follows an upward-forward direction and then follows an upward-rearward direction, and supply the sheets P one sheet at a time between the conveying belt 17 and the forwardmost photosensitive drum 11 at a prescribed timing. The conveying belt 17 then conveys the sheet P rearward. As the sheet P passes between each photosensitive drum 11 and the corresponding transfer roller 18, the toner image on the photosensitive drum 11 is transferred onto the sheet P.

The heating roller 19 and the pressure roller 20 subsequently apply heat and pressure to the sheet P as the sheet P passes therebetween. At this time, the toner image is thermally fixed to the sheet P. Subsequently, the sheet P is discharged onto a sheet discharge tray 8 (described later, see FIG. 1) through a sheet-discharge opening 23 (described later, see FIG. 2).

2. Front Cover

Figure 2:
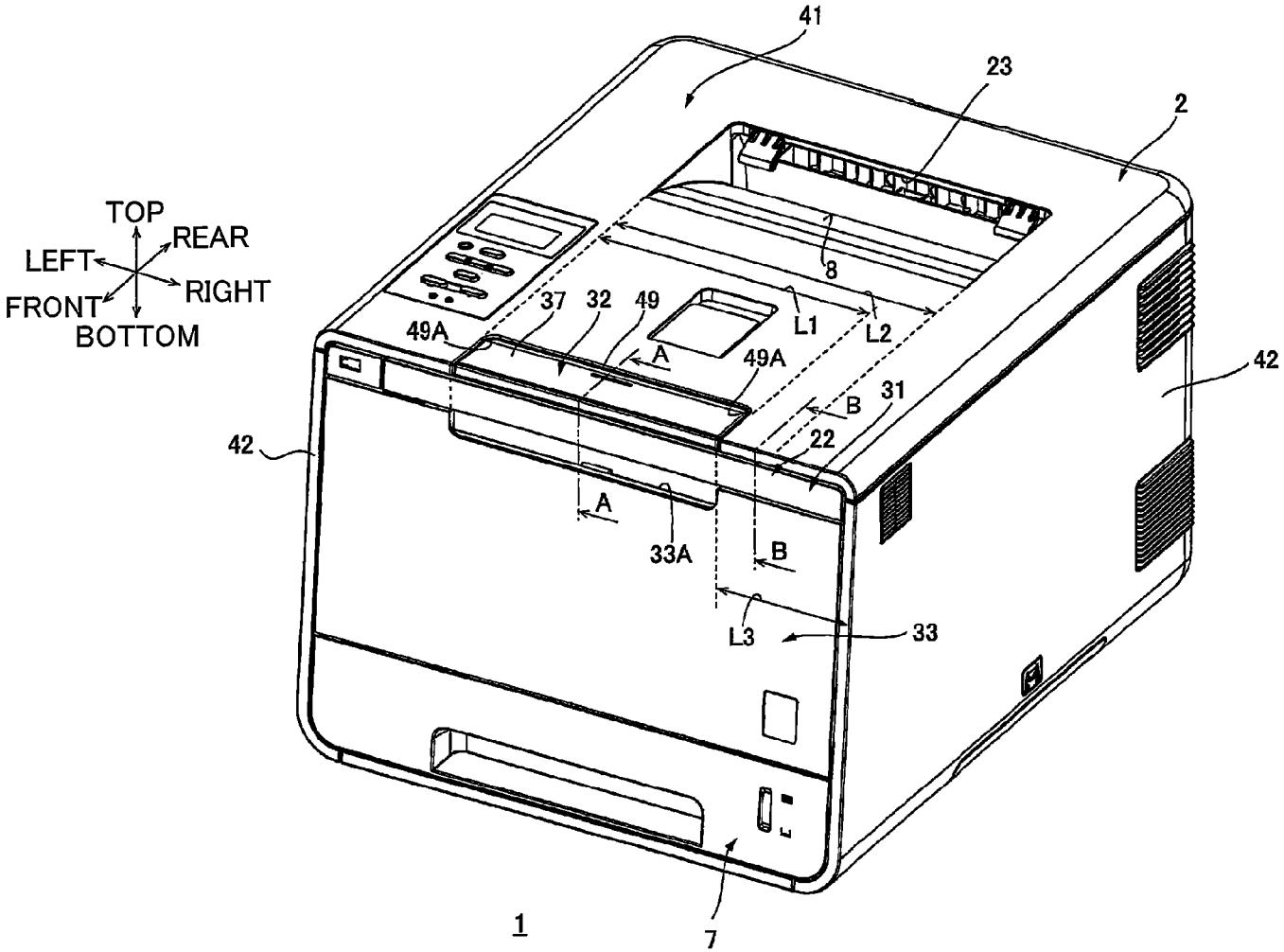
FIG. 2 is a perspective view of the printer in FIG. 1 as viewed from an upper front side thereof.
Figure 3:
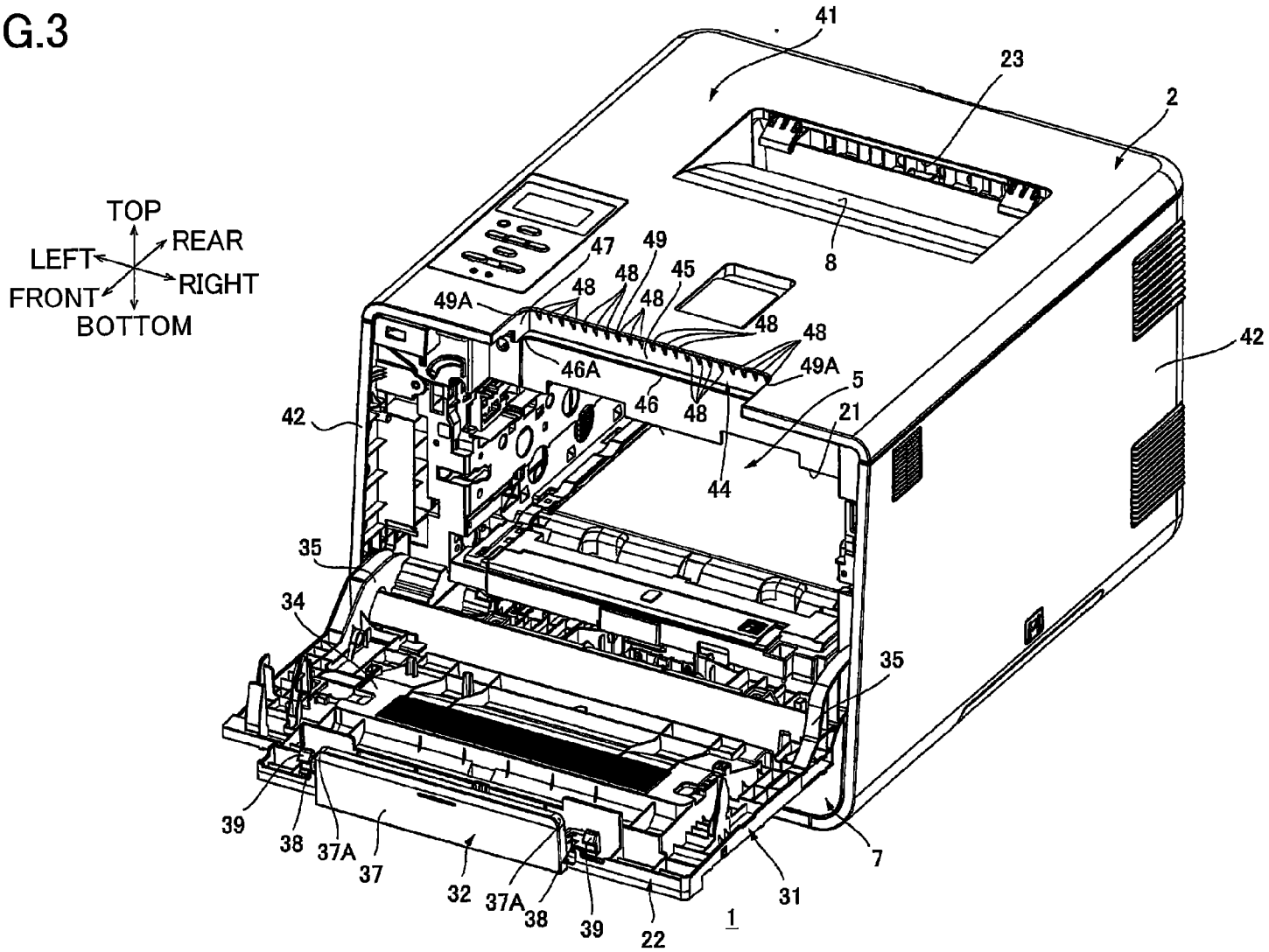
FIG. 3 is a perspective view of the printer in FIG. 2 in a state where a front cover is in its open position.

Next, the front cover 22 will be described in detail. As shown in FIGS. 2 and 3, the front cover 22 has a plate-like shape that is generally rectangular in a front view and is elongated in the left-right direction. Directions related to the front cover 22 in the following description will be based on the state of the front cover 22 in its closed position shown in FIG. 2 unless otherwise specified. The front cover 22 includes a cover body 31 as an example of an access cover, a grip member 32, and a multi-tray assembly 33 as an example of a tray assembly.

Figure 5:
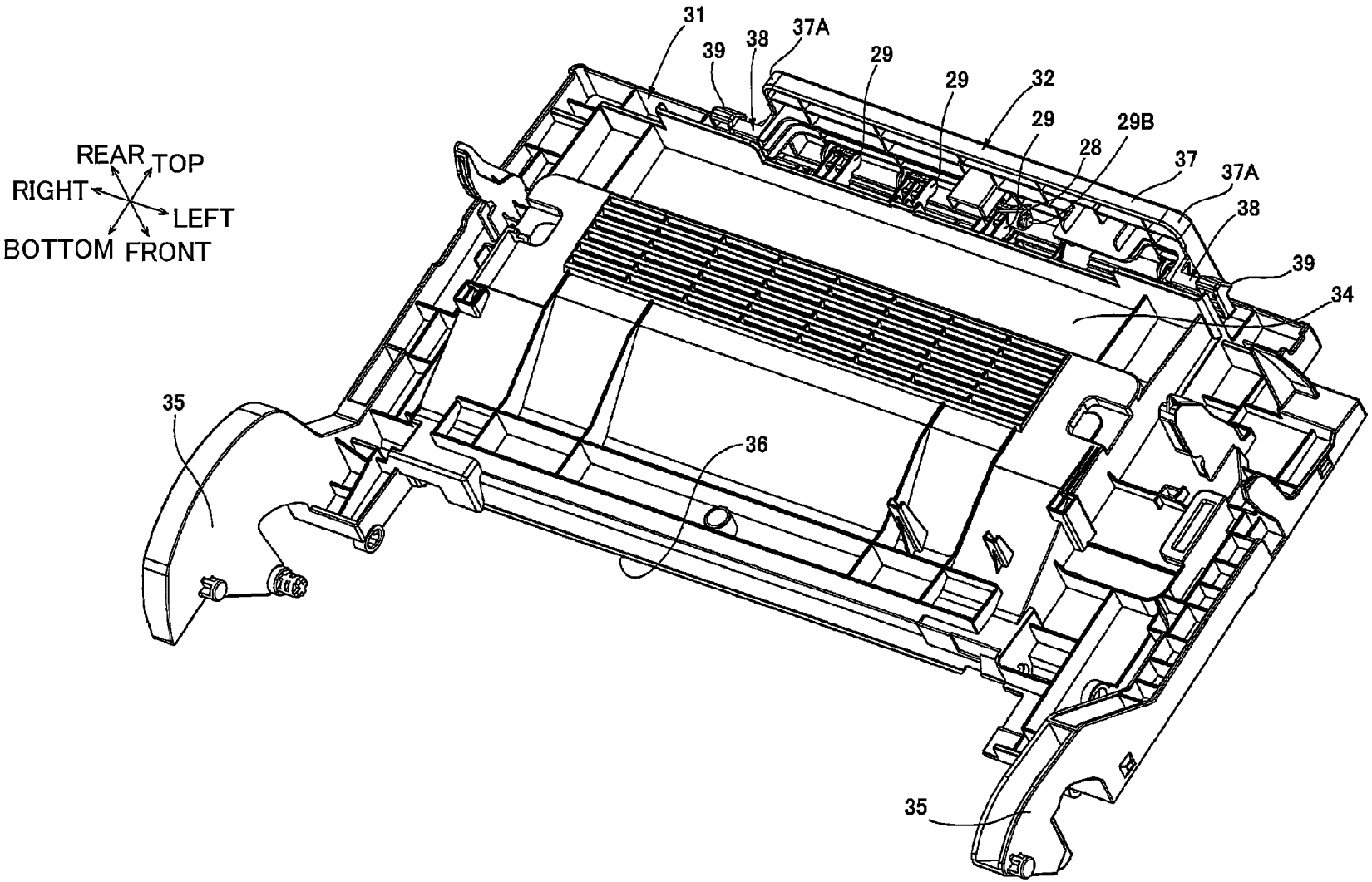
FIG. 5 is a perspective view of the front cover shown in FIG. 2 as viewed from a left rear side thereof.

As shown in FIGS. 3 and 5, the cover body 31 has a plate-like shape that is generally rectangular in a front view and is elongated in the left-right direction. The cover body 31 includes a body portion 34, and a pair of arm portions 35.

The body portion 34 has a plate-like shape that is generally rectangular in a front view and is elongated in the left-right direction. The body portion 34 includes a plurality of supporting protrusions 29, a coil spring 28, and a notched portion 36.

Each of the supporting protrusions 29 has a general prismatic columnar shape that protrudes upward from a top end of the body portion 34. The supporting protrusions 29 are arranged in juxtaposition with one another and spaced at intervals in the left-right direction. Each of the supporting protrusions 29 has a pivot shaft 29A (see FIG. 8A). The left-right center supporting protrusion 29 of the plurality of supporting protrusions 29 also has a spring support portion 29B.

Figure 8A:
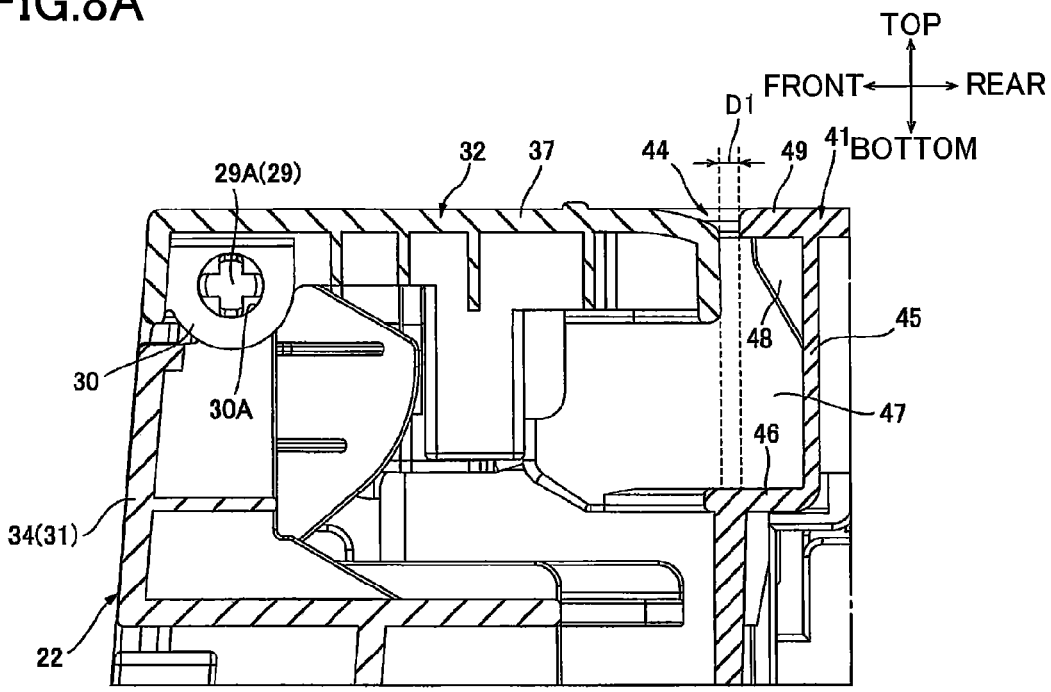
FIG. 8A is a cross-sectional view of an upper front portion of the printer taken along a line A-A in FIG. 2.

As shown in FIG. 8A, the pivot shaft 29A has a circular columnar shape with a general plus-sign shape in a side view and protrudes rightward from a right surface of the supporting protrusion 29 at a top end thereof.

As shown in FIG. 5, the spring support portion 29B has a general columnar shape that protrudes leftward from a left surface of the left-right center supporting protrusion 29 at the top end thereof.

The coil spring 28 is wound around the spring support portion 29B. One end of the coil spring 28 is anchored on the body portion 34, while the other end is capable of contacting a bottom surface of a grip portion 37 (described later) of the grip member 32. With this configuration, the coil spring 28 urges the grip portion 37 in a unlock position counterclockwise in a right side view toward a lock position.

The arm portions 35 are disposed at a lower end portion of the cover body 31, with one arm portion 35 on a left side thereof and the other arm portion 35 on a right side thereof. The arm portions 35 have a general plate-like shape and protrude downward from a lower end portion of the body portion 34. The arm portions 35 are pivotally movably supported at a lower-front end portion of the side covers 42.

The notched portion 36 is formed in an approximate left-right center region on the lower end portion of the body portion 34. The notched portion 36 has a general rectangular shape in a front view, forming a notch that extends upward from a bottom edge of the body portion 34.

Figure 6A:
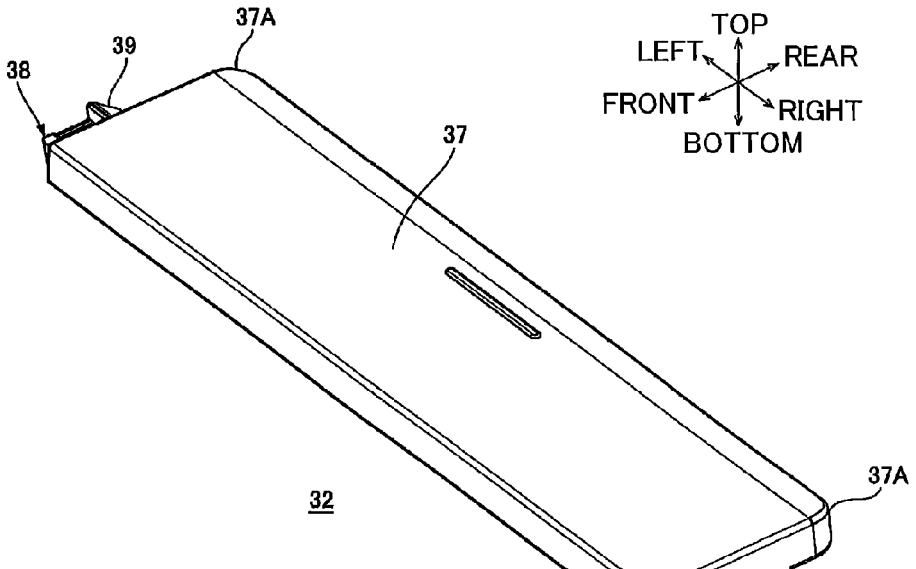
FIG. 6A is a perspective view of a grip member shown in FIG. 2 as viewed from an upper front side thereof.

As shown in FIG. 2, the grip member 32 is disposed at a top end of the front cover 22. As also shown in FIGS. 5 and 6A, the grip member 32 has a plate-like shape that is generally rectangular in a plan view and is elongated in the left-right direction. The grip member 32 can pivotally move such that the grip portion 37 pivotally moves between the lock position (see FIG. 8A) to lock a pair of engaging portions 38 (described later) into an engaged position, and the unlock position (see FIG. 10A) to unlock the pair of engaging portions 38 into an disengaged position.

The grip member 32 includes the grip portion 37 as an example of an operating member, the pair of engaging portions 38 as an example of a second engaging portion, and a plurality of insertion portions 30.

The grip portion 37 has a plate-like shape that is generally rectangular in a plan view and is elongated in the left-right direction. Rear surfaces 37A formed respectively on left and right ends of the grip portion 37 have a general arcuate shape that curves forward toward outer left-right sides.

One of the pair of engaging portions 38 is disposed at a left end of the grip member 32, while the other of the pair of engaging portions 38 is disposed at a right end of the grip member 32. The engaging portions 38 have a plate-like shape that is generally rectangular in a plan view and protrudes outward in the left-right direction from respective left and right ends of the grip portion 37. Each of the engaging portions 38 has an engaging pawl 39.

The engaging pawls 39 are provided at rear ends of the respective engaging portions 38 on outer left-right ends thereof. The engaging pawls 39 have a prismatic columnar shape that is generally triangular in a side view and protrudes above a top surface of the corresponding engaging portion 38. Front surfaces of the engaging pawls 39 extend vertically, while top surfaces of the engaging pawls 39 slope downward toward the rear. In other words, the engaging portions 38 have hook-shaped portions.

Figure 6B:
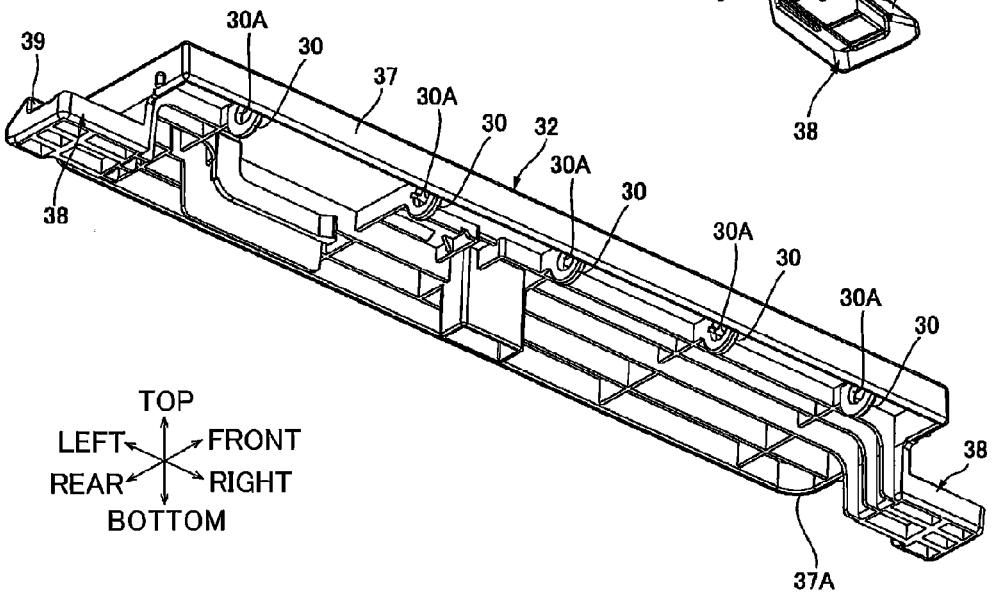
FIG. 6B is a perspective view of the grip member shown in FIG. 6A as viewed from a lower front side thereof.

As shown in FIG. 6B, the insertion portions 30 have a general plate-like shape that is elongated in the front-rear direction and protrudes downward from the bottom surface of the grip portion 37. The insertion portions 30 are arranged in juxtaposition with one another and spaced at intervals in the left-right direction. Each of the insertion portions 30 has a through-hole 30A.

The through-hole 30A has a general circular shape in a side view and penetrates the corresponding insertion portion 30 in the left-right direction. The through-holes 30A rotatably receive the corresponding pivot shafts 29A of the cover body 31.

Figure 4:
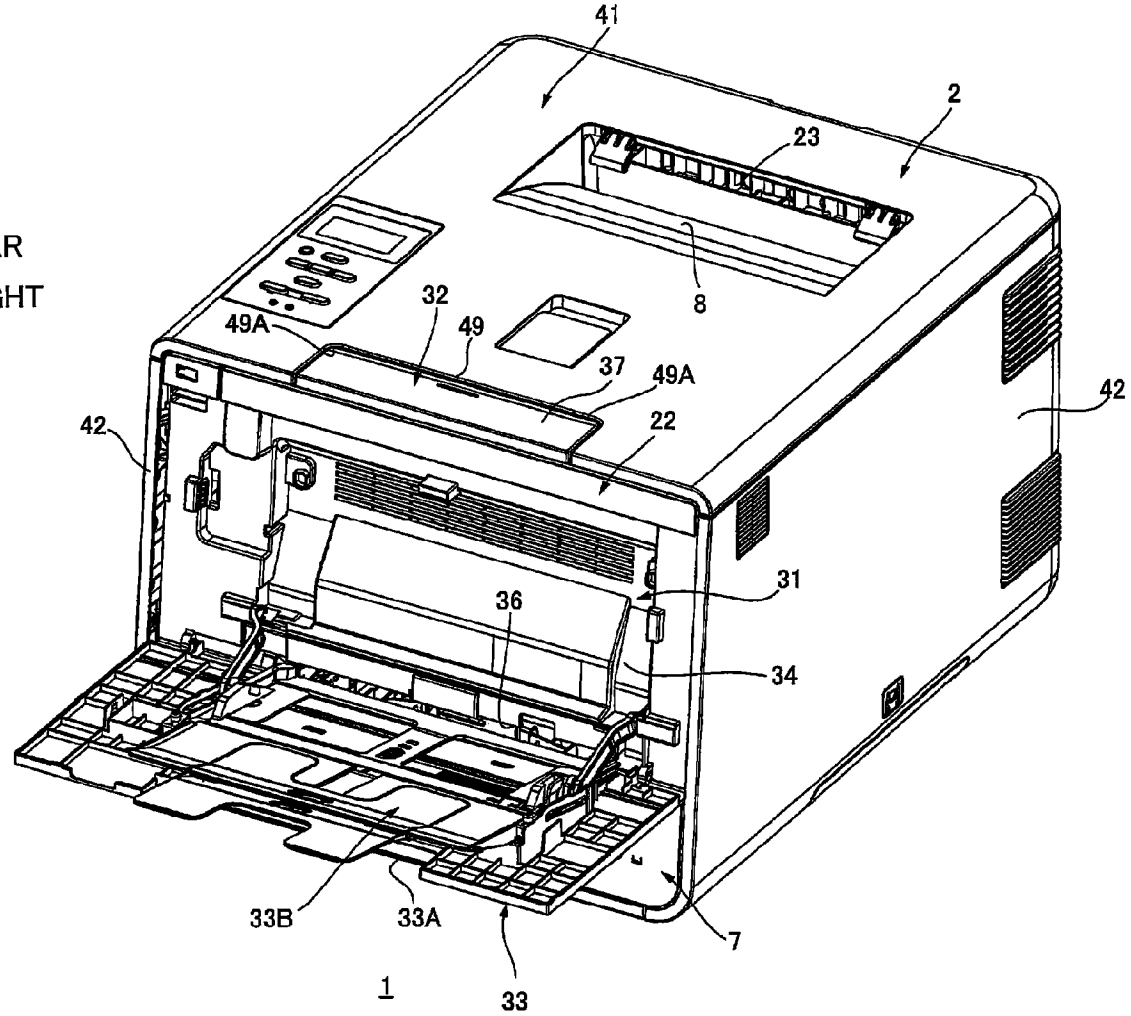
FIG. 4 is a perspective view of the printer in FIG. 2 in a state where a multi-tray assembly is in its first position.
Figure 4:
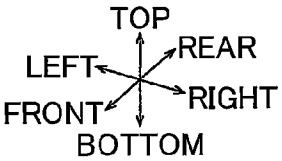

As shown in FIGS. 2 and 4, the multi-tray assembly 33 is provided at a front end of the front cover 22 so as to overlap a front surface of the cover body 31. The multi-tray assembly 33 has a plate-like shape that is generally rectangular in a front view. The multi-tray assembly 33 is supported at a lower end portion of the body portion 34 of the cover body 31 so as to be capable of pivotally moving about its lower end portion. When the front cover 22 is in the closed position, the multi-tray assembly 33 can pivotally move about its lower end portion between a first position (see FIG. 4) and a second position (see FIG. 2). In the first position, the multi-tray assembly 33 is open relative to the cover body 31. In the second position, the multi-tray assembly 33 is closed relative to the cover body 31. The multi-tray assembly 33 has an operating recess 33A as an example of a tray operating portion, and a sheet support portion 33B.

The operating recess 33A is formed at a top end of the multi-tray assembly 33. The operating recess 33A has a general rectangular shape in a front view and is recessed downward from a top edge of the multi-tray assembly 33. A left-right dimension of the operating recess 33A is equal to a left-right dimension L1 of the grip portion 37 of the grip member 32.

The sheet support portion 33B is disposed in an approximate left-right center region on a rear surface of the multi-tray assembly 33 so as to face upward when the multi-tray assembly 33 is in the first position. The sheet support portion 33B has a collapsible configuration formed from a plurality of plates having a general rectangular shape. The sheet support portion 33B is used when feeding sheets P different from the sheets P in the sheet supply tray 7, such as sheets P having a size different from that of the sheets P in the sheet supply tray 7, through the notched portion 36 formed in the cover body 31 toward a position between the conveying belt 17 and the forwardmost photosensitive drum 11.

3. Top Cover and Side Covers

Next, the top cover 41 and the pair of side covers 42 will be described in detail.

Figure 7:
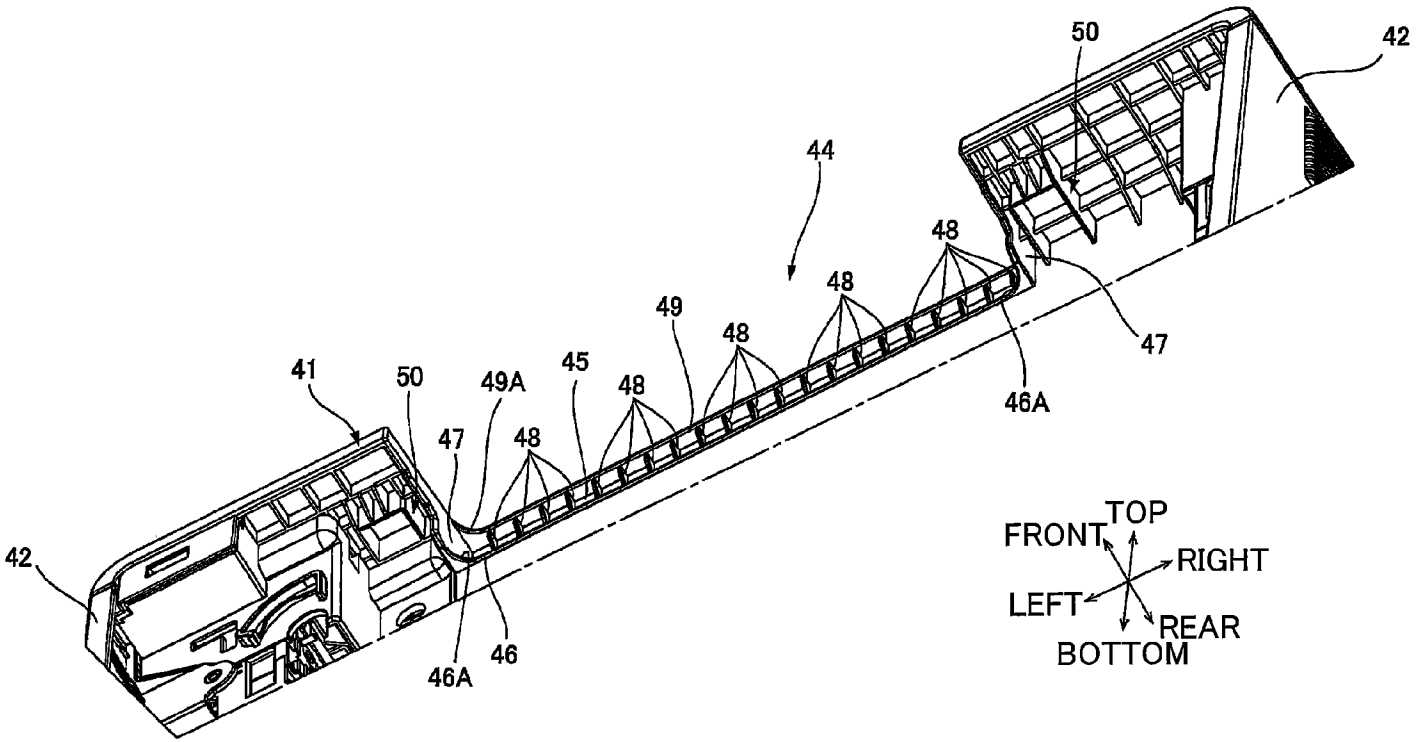
FIG. 7 is a perspective view of a front end portion of a top cover shown in FIG. 3 as viewed from a lower front side thereof.

As shown in FIGS. 3 and 7, the top cover 41 is provided at a top portion of the main casing 2. The top cover 41 has a plate-like shape that is generally rectangular in a plan view. The top cover 41 has a recessed portion 44, a pair of receiving portions 50 as an example of a first engaging portion, the sheet discharge tray 8, and the sheet-discharge opening 23 as an example of a discharge opening.

As shown in FIGS. 3 and 8A, the recessed portion 44 is formed in a front end portion of the top cover 41. The recessed portion 44 is recessed rearward from a front edge of the top cover 41 and has a general rectangular shape in a plan view. The recessed portion 44 has a rear wall 45 as an example of a first wall, a top wall 49, a bottom wall 46 as an example of a second wall, a pair of side walls 47 as an example of a third wall or a fourth wall, and a plurality of ribs 48.

The rear wall 45 defines a rear side of the recessed portion 44. The rear wall 45 has a general plate-like shape and is elongated vertically.

The top wall 49 is defines a top side of a rear end portion of the recessed portion 44. The top wall 49 has a general plate-like shape that is elongated in the left-right direction and protrudes forward from a top edge of the rear wall 45. Front edges 49A formed respectively on left and right ends of the top wall 49 have a general arcuate shape that curves forward toward outer left-right sides and conforms to the rear surfaces 37A formed on the left and right ends of the grip portion 37 in the lock position. When the grip portion 37 is in the lock position, a gap D1 is formed between a front edge of the top wall 49 and a rear edge of the grip portion 37. The front edge of the top wall 49 is an example of a recessed edge.

The bottom wall 46 is defines a bottom side of the rear end portion of the recessed portion 44. The bottom wall 46 has a general plate-like shape that is elongated in the left-right direction and protrudes forward from a bottom edge of the rear wall 45. A front edge of the bottom wall 46 is positioned further forward than the rear edge of the grip portion 37 when the grip portion 37 is in the lock position. Front edges 46A formed respectively on left and right ends of the bottom wall 46 have a general arcuate shape that curves forward toward outer left-right sides and conforms to the rear surfaces 37A formed on the left and right ends of the grip portion 37 in the unlock position.

The side walls 47 define respective left and right sides of the rear end portion of the recessed portion 44. The side walls 47 have a general plate-like shape that extends forward from corresponding left and right ends of the rear wall 45. Top edges of the side walls 47 continue from respective left and right edges of the top wall 49. Bottom edges of the side walls 47 continue from respective left and right edges of the bottom wall 46.

The plurality of ribs 48 are arranged in juxtaposition with one another and at intervals in the left-right direction between the side walls 47. The ribs 48 each extend vertically and protrude forward from a top portion of the rear wall 45. In other words, the ribs 48 each protrude from the rear wall 45 toward the front edge of the top wall 49. Top edges of the ribs 48 continuous with the top wall 49, while bottom edges of the ribs 48 are spaced apart from the bottom wall 46. Front edges of the ribs 48 slope forward from bottom to top.

Figure 8B:
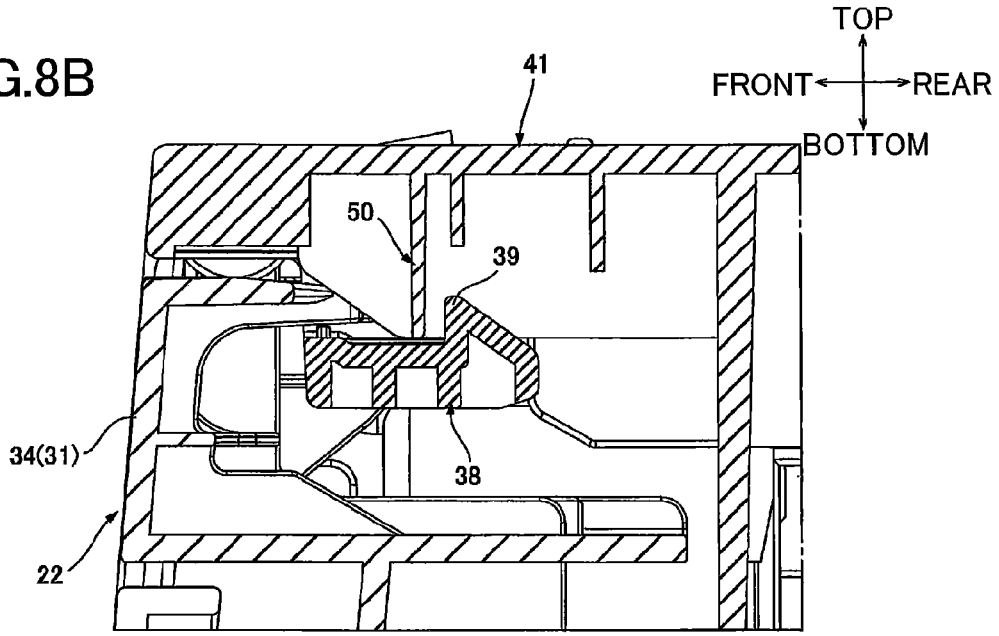
FIG. 8B is a cross-sectional view of an upper front portion of the printer taken along a line B-B in FIG. 2.

As shown in FIGS. 7 and 8B, the receiving portions 50 are provided at the top cover 41. More specifically, the receiving portions 50 are provided adjacent to but outside of the respective left and right sides of the recessed portion 44. The receiving portions 50 have a general hollow prismatic columnar shape and extend downward from a bottom surface of the top cover 41. In other words, the receiving portions 50 overlap the top cover 41 as viewed from above.

As shown in FIG. 2, the sheet discharge tray 8 is provided at the top cover 41 and adapted to receive the sheets P discharged from the main casing 2. More specifically, the sheet discharge tray 8 is provided in a rear half portion of the top cover 41. The sheet discharge tray 8 is recessed downward from an upper surface of the top cover 41 and has a general rectangular shape in a plan view. As depicted with dashed lines in FIG. 2, a left-right dimension L2 of the sheet discharge tray 8 is greater than a left-right dimension L1 of the grip portion 37 of the grip member 32. Here, a left edge of the sheet discharge tray 8 is aligned in the left-right direction with a left edge of the grip portion 37, while a right edge of the sheet discharge tray 8 is positioned further rightward than a right edge of the grip portion 37. Consequently, a left-right center of the sheet discharge tray 8 is positioned rightward of a left-right center of the grip portion 37. That is, the left-right center of the sheet discharge tray 8 is positioned offset from the left-right center of the grip portion 37 in the left-right direction.

The sheet-discharge opening 23 is formed in a top portion of a rear wall defining the sheet discharge tray 8 for allowing the sheets P discharged from the main casing 2 to pass therethrough. The sheet-discharge opening 23 has a general rectangular shape in a front view and extends across approximately an entire width of the sheet discharge tray 8 in the left-right direction. Accordingly, a left-right center of the sheet-discharge opening 23 is also positioned rightward of the left-right center of the grip portion 37. The sheet-discharge opening 23 is positioned so as to overlap the grip portion 37 of the grip member 32 as viewed from front.

The side covers 42 is provided at left and right ends of the main casing 2. The side covers 42 have a general rectangular shape in a side view and extend vertically. A distance L3 between an outer surface of each side cover 42 in the left-right direction and a corresponding one of left and right edges of the recessed portion 44 is shorter than the left-right dimension L1 of the grip portion 37.

4. Maintenance Operations for Developer Cartridges

Next, maintenance operations for the developer cartridges 10 will be described. Prior to performing the maintenance operations for the developer cartridges 10, the front cover 22 is in the closed position shown in FIG. 2. At this time, the grip portion 37 of the grip member 32 is in the lock position within the recessed portion 44, as shown in FIGS. 2 and 8A. An upper surface of the grip portion 37 in the lock position is flush with the upper surface of the top cover 41. The engaging pawls 39 of the grip member 32 are fitted into the corresponding receiving portions 50, as shown in FIG. 8B. Thus, the pair of engaging portions 38 of the grip member 32 are in engagement with the pair of receiving portions 50. The engaging portions 38 are in the engaged position at this time.

(1) Opening and Closing Operations for Front Cover

To perform maintenance operations for the developer cartridges 10, an operator first moves the front cover 22 from the closed position to the open position.

Figure 9:
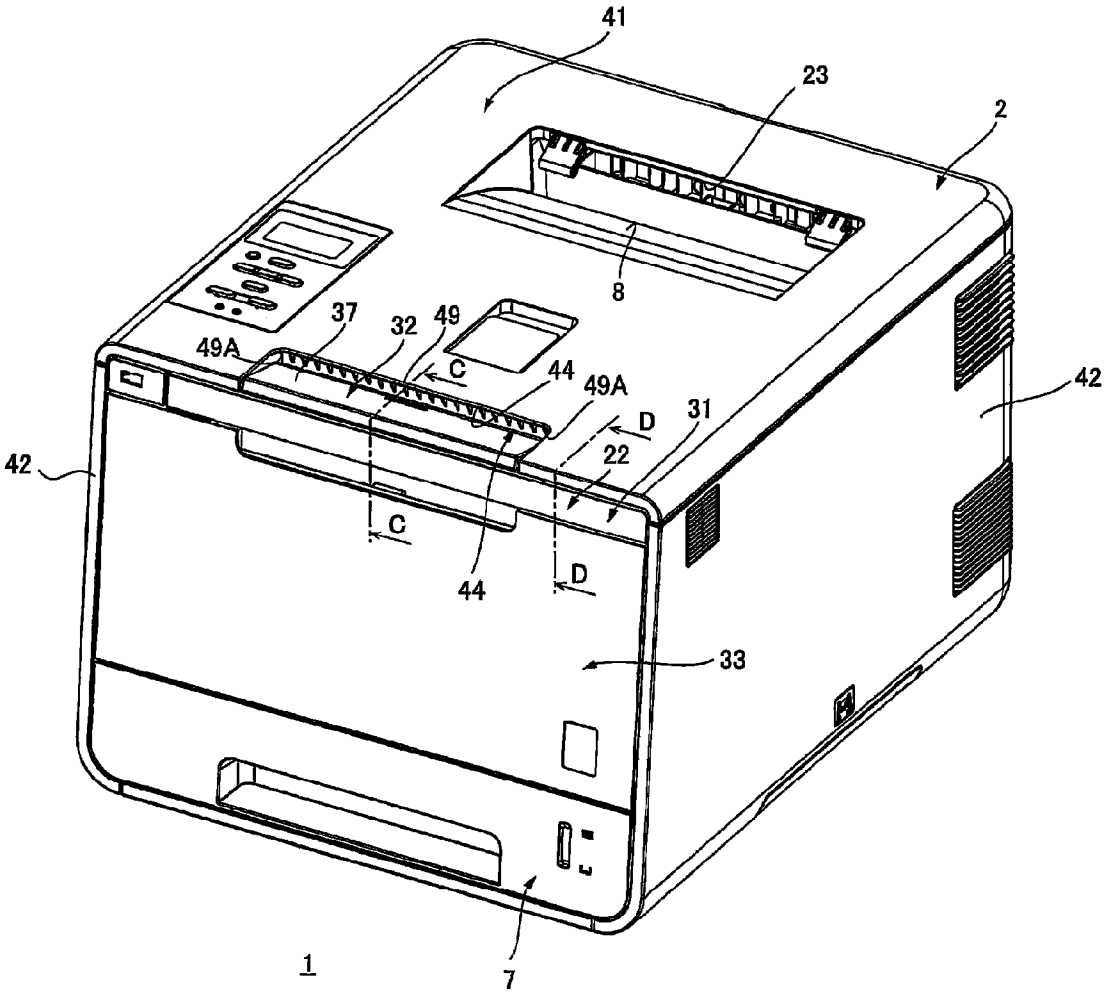
FIG. 9 is a perspective view of the printer shown in FIG. 2 in a state where a grip portion of the grip member is in its unlock position.
Figure 9:
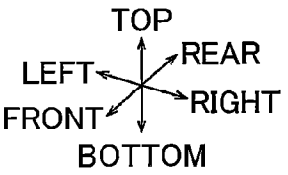

To move the front cover 22 from the closed position to the open position, the operator pushes a rear end portion of the grip portion 37 downward, as shown in FIG. 9.

At this time, the sheets P that were discharged from the main casing 2 through the sheet-discharge opening 23 during the image-forming operation described above may be resting in the sheet discharge tray 8. In this case, the leading edges of the sheets P may overlap the grip portion 37 of the grip member 32. However, since the grip portion 37 is positioned offset leftward relative to the sheet discharge tray 8, a left end portion of the grip portion 37 will be exposed on a side of the sheets P. Accordingly, the operator can push down on the exposed left end portion of the grip portion 37.

Figure 10A:
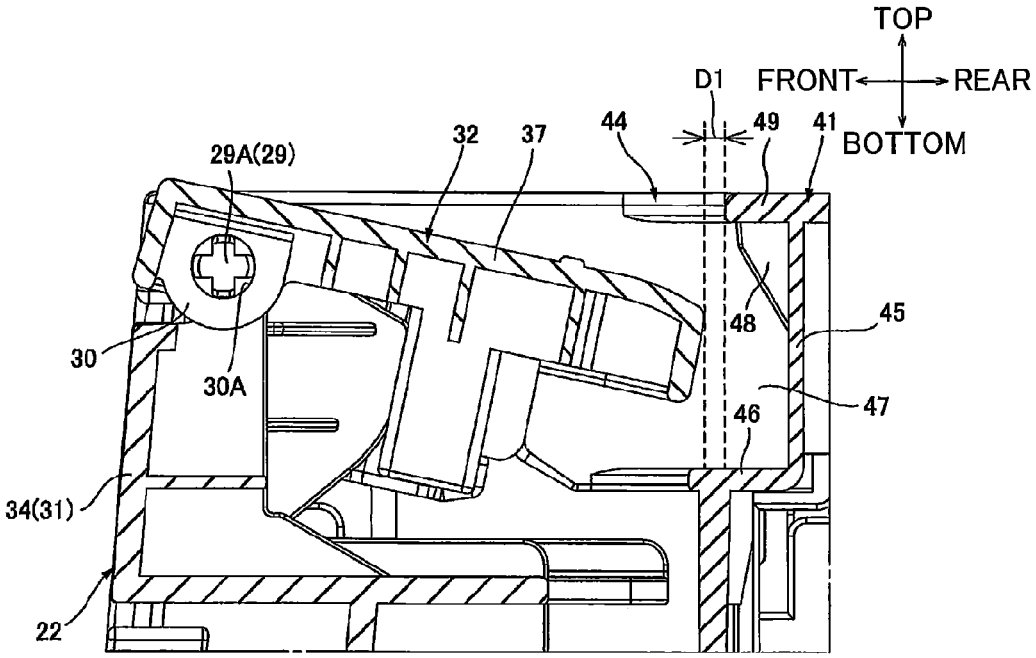
FIG. 10A is a cross-sectional view of an upper front portion of the printer taken along a line C-C in FIG. 9 in a state where the grip portion is in the unlock position and illustrates a pivoting operation of the grip portion.

When the rear end portion of the grip portion 37 is pushed downward, the grip member 32 pivotally moves clockwise in a right side view about the pivot shafts 29A to move the grip portion 37 into the unlock position shown in FIG. 10A. At this time, the rear edge of the grip portion 37 is positioned above the bottom wall 46 and further rearward than the front edge of the bottom wall 46 such that the rear edge of the grip portion 37 across its entire left-right dimension overlaps the bottom wall 46 as viewed from above. Further, rear edges of the left and right end portions of the grip portion 37 at which the rear surfaces 37A is provided are also positioned above the bottom wall 46 and further rearward than the front edge of the bottom wall 46 so as to overlap the bottom wall 46 as viewed from above. In other words, an imaginary vertical plane containing a portion of a rear end surface of the grip portion 37 intersects the bottom wall 46.

Figure 10B:
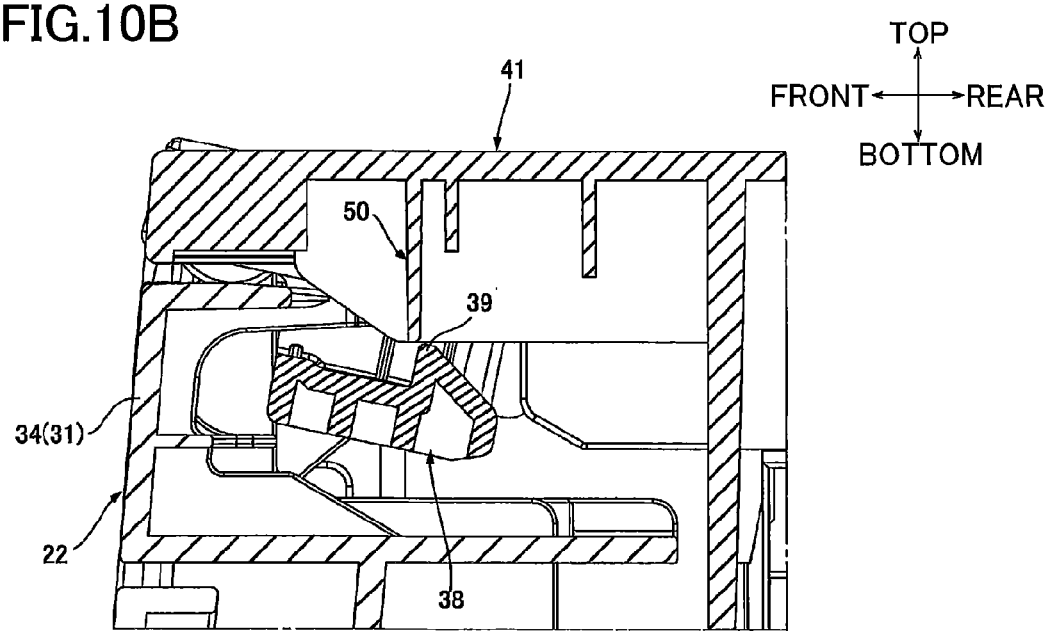
FIG. 10B is a cross-sectional view of an upper front portion of the printer taken along a line D-D in FIG. 9 in a state where the grip portion is in the unlock position and illustrates the pivoting operation of the grip portion together with FIG. 10A.

At the same time, the engaging pawls 39 of the grip member 32 are separated below the corresponding receiving portions 50 provided at the top cover 41, as shown in FIG. 10B. Thus, the engaging pawls 39 are disengaged from the corresponding receiving portions 50, allowing the front cover 22 to pivotally move. Thus, the pair of engaging portions 38 of the grip member 32 are out of engagement with the pair of receiving portions 50. The engaging portions 38 are in the disengaged position at this time.

Next, the operator pulls the grip portion 37 forward while maintaining the grip portion 37 in its unlock position, pivotally moving the front cover 22 counterclockwise in a right side view.

This action places the front cover 22 in the open position shown in FIG. 3 and exposes the opening 21 formed in the main casing 2.

(2) Maintenance Operations for Developer Cartridges

To perform maintenance operations for the developer cartridges 10, the operator next pulls the process unit 3 outward of the main casing 2, as indicated in the two-dotted chain lines in FIG. 1. The operator pulls one of the developer cartridges 10 upward from the drum unit 9 and performs maintenance thereon.

When performing maintenance at this time, the operator may work near the opening 21, particularly when performing maintenance on the rearmost developer cartridge 10. However, since the receiving portions 50 are provided on the bottom surface of the top cover 41, the operator can perform maintenance on the developer cartridges 10 without coming into contact with the receiving portions 50.

5. Operational Advantages (1) With the printer 1 according to the embodiment, the receiving portions 50 are positioned to overlap the top cover 41 as viewed from above, as shown in FIG. 7.

This arrangement reduces the likelihood of an operator contacting the receiving portions 50 when performing maintenance operations after moving the front cover 22 into the open position.

Thus, this configuration can improve working efficiency for maintenance operations performed after moving the front cover 22 into its open position.

(2) As shown in FIGS. 2 and 4, the operating recess 33A formed in the multi-tray assembly 33 has the left-right dimension equal to that of the grip portion 37.

This configuration facilitates operations of the multi-tray assembly 33.

(3) As shown in FIG. 2, the left-right center of the sheet discharge tray 8 is positioned rightward of the left-right center of the grip portion 37.

Accordingly, when the sheets P are resting in the sheet discharge tray 8, the left end portion of the grip portion 37 is exposed on the side of the sheets P.

This configuration can improve working efficiency for operating the grip portion 37 when the sheets P are resting in the sheet discharge tray 8.

(4) As shown in FIGS. 8A and 10A, the grip portion 37 can be pivotally moved between the lock position and the unlock position.

Accordingly, the grip portion 37 can be manipulated through a simple operation, thereby further improving operating efficiency of the grip portion 37.

(5) As shown in FIG. 8A, the gap D1 formed between the grip portion 37 and the top wall 49 can be blocked by the bottom wall 46 as viewed from above.

Thus, this configuration can prevent dust and the like entering through the gap D1 formed between the grip portion 37 and the top wall 49 from falling into the main casing 2.

(6) As shown in FIG. 7, the ribs 48 provided in the recessed portion 44 are continuous with the top wall 49, are elongated vertically, and protrude forward from the rear wall 45.

Accordingly, the ribs 48 can prevent the operator from getting a finger caught under the top wall 49 of the recessed portion 44.

(7) As shown in FIG. 10A, the rear edge of the grip portion 37 across its entire left-right dimension is positioned further rearward than the front edge of the bottom wall 46 so as to overlap the bottom wall 46 as viewed from above.

Thus, the bottom wall 46 can still block the gap D1 formed between the grip portion 37 and the top wall 49 in a plan view, even when the gap D1 is expanded by moving the grip portion 37 to the unlock position.

Thus, this configuration can further prevent dust and the like entering through the gap D1 formed between the grip portion 37 and the top wall 49 from falling into the main casing 2.

(8) As shown in FIGS. 3 and 7, the side walls 47 of the recessed portion 44 protrude forward from the respective left and right ends of the rear wall 45, and continue from the top wall 49 and the bottom wall 46.

Hence, the side walls 47 close the left and right ends of the recessed portion 44 above the bottom wall 46.

Accordingly, this configuration can even further prevent dust and the like that enters through the gap D1 formed between the grip portion 37 and the top wall 49 from falling into the main casing 2.

(9) As shown in FIG. 2, the left-right dimension L 1 of the grip portion 37 is greater than the distance L3 between the left/right edge of the recessed portion 44 and the outer surface of the corresponding side cover 42 in the left-right direction.

Accordingly, the left-right dimension L1 of the grip portion 37 can be set considerably large relative to the left-right dimension of the main casing 2, thereby improving ease of operation for the grip portion 37.

(10) As shown in FIG. 2, the sheet-discharge opening 23 overlaps the grip portion 37 as viewed from front.

Although the sheets P discharged from the main casing 2 through the sheet-discharge opening 23 may lay over the grip portion 37, the configuration described above can still improve operating efficiency of the grip portion 37 in this case.

(11) As shown in FIG. 2, the top cover 41 has the sheet discharge tray 8, thereby providing the sheet discharge tray 8 through efficient use of the top cover 41.

While the present invention has been described in detail with reference to the embodiment thereof, it would be apparent to those skilled in the art that various changes and modifications may be made therein without departing from the spirit of the present invention.

What is claimed is:

1. An image forming apparatus comprising:

a casing comprising:

a base portion;

a top cover provided above the base portion, the top cover having an edge and a recessed portion recessed from the edge; and an access assembly provided at one side of the base portion and configured to pivotally move relative to the base portion between an open position in which the access assembly is remote from the edge of the top cover, and a closed position in which the access assembly is proximal to the edge of the top cover, the access assembly having a pivot axis extending in an axial direction;

a first engaging portion provided at a position overlapping the cover as viewed from above, the position being outside of the recessed portion in the axial direction;

a second engaging portion provided at the access assembly and configured to move between an engaged position in which the second engaging portion is in engagement with the first engaging portion and a disengaged position in which the second engaging portion is out of engagement with the first engaging portion; and an operating member provided at the access assembly and configured to be positioned in the recessed portion when the access assembly is in the closed position, the operating member being configured to move between a lock position to lock the second engaging portion into the engaged position and an unlock position to unlock the second engaging portion into the disengaged position.

2. The image forming apparatus as claimed in claim 1, wherein, the operating member has a length in the axial direction, wherein the casing has an opening, the access assembly in the closed position covering the opening and the access assembly in the open position exposing the opening, and wherein the access assembly comprises:

an access cover configured to cover the opening when the access assembly is in the closed position; and a tray assembly configured to move between a first position and a second position when the access assembly is in the closed position, the tray assembly being open relative to the access cover when the tray assembly is in the first position and being closed relative to the access cover when the tray assembly is in the second position, the tray assembly including a tray operating portion having a length in the axial direction, the length of the tray operating portion being equal to the length of the operation member.

3. The image forming apparatus as claimed in claim 1, wherein, the operating member has a center in the axial direction, and wherein the top cover includes a discharge tray configured to receive a recording medium discharged from the casing, the discharge tray having a center in the axial direction, the center of the discharge tray being positioned offset from the center of the operating member in the axial direction.

4. The image forming apparatus as claimed in claim 1, wherein the operating member is configured to pivotally move between the lock position and the unlock position.

5. The image forming apparatus as claimed in claim 4, wherein the second engaging portion is configured to move from the engaged position to the disengaged position together with the pivotal movement of the operating member from the lock position to the unlock position.

6. The image forming apparatus as claimed in claim 1, wherein the recessed portion includes:

a recessed edge extending in the axial direction and recessed relative to the edge of the top cover in a direction away from the access assembly in the closed position;

a first wall positioned farther from the access assembly in the closed position than the recessed edge and extending in a vertical direction; and a second wall protruding from the first wall toward the access assembly in the closed position and extending in the axial direction.

7. The image forming apparatus as claimed in claim 1, wherein the operating member has a length in the axial direction, wherein the recessed portion has a first edge and a second edge facing the first edge in the axial direction, wherein the base portion comprises a first side cover and a second side cover facing the first side cover in the axial direction, the first side cover being disposed closer to the first edge than to the second edge and having a first outer surface in the axial direction, and wherein the first edge and the first outer surface defining a first distance, the length of the operating member being greater than the first distance.

8. The image forming apparatus as claimed in claim 1, wherein the casing has a discharge opening to allow a recording medium discharged from the casing to pass therethrough, the recording medium passing through the discharge opening in a discharging direction, and wherein the discharge opening overlaps the operating member as viewed in the discharging direction.

9. The image forming apparatus as claimed in claim 1, wherein the top cover includes a discharge tray configured to receive a recording medium discharged from the casing.

10. The image forming apparatus as claimed in claim 1, wherein the first engaging portion is provided at the top cover and extends downward, and the second engaging portion includes a hook portion configured to engage the first engaging portion when the operating member is in the lock position.

11. The image forming apparatus as claimed in claim 1, wherein the first engaging portion is provided at the top cover.

12. The image forming apparatus as claimed in claim 1, wherein an upper surface of the operating member in the lock position is flush with an upper surface of the top cover.

13. An image forming apparatus comprising:

a casing comprising:

a base portion;

an access assembly provided at one side of the base portion and configured to pivotally move relative to the base portion between an open position and a closed position, the access assembly having a pivot axis extending in an axial direction; and a cover provided above the base portion, the cover having an edge proximal to the access assembly in the closed position and a recessed portion recessed from the edge in a direction away from the access assembly in the closed position, the recessed portion including:

a recessed edge extending in the axial direction and recessed relative to the edge of the cover in the direction away from the access assembly in the closed position;

a first wall positioned farther from the access assembly in the closed position than the recessed edge and extending in a vertical direction; and a second wall protruding from the first wall toward the access assembly in the closed position and extending in the axial direction;

a first engaging portion provided at a position overlapping the cover as viewed from above;

a second engaging portion provided at the access assembly and configured to move between an engaged position in which the second engaging portion is in engagement with the first engaging portion and a disengaged position in which the second engaging portion is out of engagement with the first engaging portion; and an operating member provided at the access assembly and configured to be positioned in the recessed portion when the access assembly is in the closed position, the operating member being configured to move between a lock position to lock the second engaging portion into the engaged position and an unlock position to unlock the second engaging portion into the disengaged position.

14. The image forming apparatus as claimed in claim 13, wherein the recessed portion includes a plurality of ribs each protruding from the first wall toward the recessed edge and each extending in a direction perpendicular to the axial direction.

15. The image forming apparatus as claimed in claim 13, wherein the operating member has end portions in the axial direction, the end portions having an arcuate shape, and wherein the second wall has end portions in the axial direction, the end portions of the second wall having an arcuate shape in conformance with the arcuate portion of the end portions of the operating member when the operating member is in the unlock position.

16. The image forming apparatus as claimed in claim 13, wherein the operating member has an end surface extending along the first wall and facing the first wall when the operating member is in the lock position, and wherein the second wall intersects an imaginary vertical plane containing a portion of the end surface of the operating member when the operating member is in the unlock position.

17. The image forming apparatus as claimed in claim 13, wherein the first wall has a first end and a second end in the axial direction, and wherein the recessed portion further includes a third wall protruding from the first end of the first wall toward the access assembly in the closed position and a fourth wall protruding from the second end of the first wall toward the access assembly in the closed position, the third wall and the fourth wall continuing from the second wall.

18. An image forming apparatus comprising:

a casing comprising:

a base portion;

an access assembly provided at one of the base portion and configured to pivotally move relative to the base portion between an open position and a closed position, the access assembly having a pivot axis extending in an axial direction; and a cover provided above the base portion the cover having an edge proximal to the access assembly in the closed position and a recessed portion recessed from the edge in a direction away from the access assembly in the closed position, the recessed portion having a first edge and a second edge facing the first edge in the axial direction, the base portion comprising a first side cover and a second side cover facing the first side cover in the axial direction, the first side cover being disposed closer to the first edge than to the second edge and having a first outer surface in the axial direction;

a first engaging portion provided at a position overlapping the cover as viewed from above;

a second engaging portion provided at the access assembly and configured to move between an engaged position in which the second engaging portion is in engagement with the first engaging portion and a disengaged position in which the second engaging portion is out of engagement with the first engaging portion; and an operating member provided at the access assembly and configured to be positioned in the recessed portion when the access assembly is in the closed position, the operating member being configured to move between a lock position to lock the second engaging portion into the engaged position and an unlock position to unlock the second engaging portion into the disengaged position, the operating member having a length in the axial direction, the first edge and the first outer surface defining a first distance, the length of the operating member being greater than the first distance.

* * * * *